United States Patent [19]

Marconnet

[11] Patent Number: 4,955,722

[45] Date of Patent: Sep. 11, 1990

[54] APPLIANCE FOR THE PREPARATION OF BITUMINOUS COATED PRODUCTS WITH A STATIONARY MIXER

[75] Inventor: Guy Marconnet, Rive de Gier, France

[73] Assignee: Ermont, C.M., Lorette, France

[21] Appl. No.: 365,381

[22] Filed: Jun. 13, 1989

[30] Foreign Application Priority Data

Jun. 13, 1988 [FR] France ..... 88 07857

[51] Int. Cl.[5] ..... B28C 5/14; B28C 5/20

[52] U.S. Cl. ..... 366/25; 366/40; 366/64; 432/111; 432/118

[58] Field of Search ..... 366/24, 25, 7, 57, 58, 366/59, 64, 66, 40, 33, 34, 37, 42, 35, 50, 56; 432/106, 110, 111, 105, 109, 118, 14, 136, 139; 34/33, 132, 137

[56] References Cited

U.S. PATENT DOCUMENTS

| | | | |
|---|---|---|---|
| Re. 32,206 | 7/1986 | Bracegirdle | 366/7 |
| 1,836,754 | 12/1931 | Hepburn | 366/25 |
| 2,305,938 | 12/1942 | Turnbull | 366/25 |
| 2,421,345 | 5/1947 | McConnaughay | 366/25 |
| 3,423,222 | 1/1969 | McConnaughay | 366/64 X |
| 4,095,285 | 6/1978 | Malbrunot | 366/23 |
| 4,165,184 | 8/1979 | Schlarmann | 366/24 X |
| 4,211,490 | 7/1980 | Brock et al. | 366/12 X |
| 4,240,754 | 12/1980 | Mendenhall | 366/25 X |
| 4,427,376 | 1/1984 | Etnyre et al. | 432/105 |
| 4,616,934 | 10/1986 | Brock | 366/25 X |
| 4,787,938 | 11/1988 | Hawkins | 432/19 X |
| 4,813,784 | 3/1989 | Musil | 366/24 |

FOREIGN PATENT DOCUMENTS

| | | | |
|---|---|---|---|
| 3423521 | 1/1986 | Fed. Rep. of Germany | 366/25 |
| 1270198 | 11/1986 | U.S.S.R. | 366/25 |

*Primary Examiner*—Chris K. Moore
*Assistant Examiner*—Scott J. Haugland
*Attorney, Agent, or Firm*—Pollock, Vande Sande & Priddy

[57] ABSTRACT

A mixer (10) consisting of a stationary casing (9), into which the outlet end (2b) of a rotary drum (2) opens, and mixing vanes fixed to the casing of the drum (2) and extending this casing axially in the direction of its outlet (2b). A burner (13) having an elongate body (12) projects into the drum (2) at its outlet end (2b) and opens into a flame zone (22). A recycling ring (32) is arranged around the drum (2) in the vicinity of the end (12a) of a burner. The casing (9) of the mixer delimits a mixing zone (36), separate from the flame zone (22), around the body (12) of the burner.

5 Claims, 4 Drawing Sheets

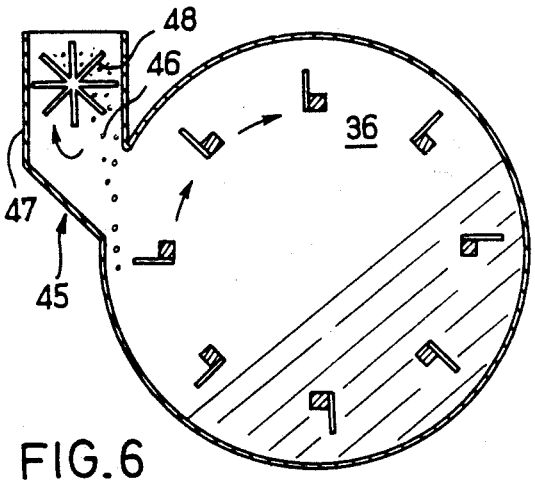
FIG. 6
FIG. 7
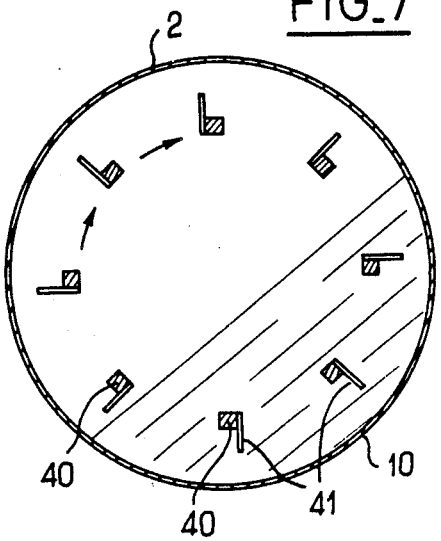
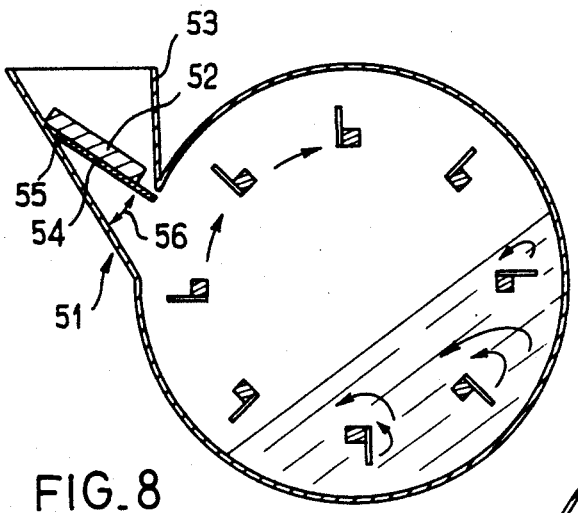
FIG. 8
FIG. 9
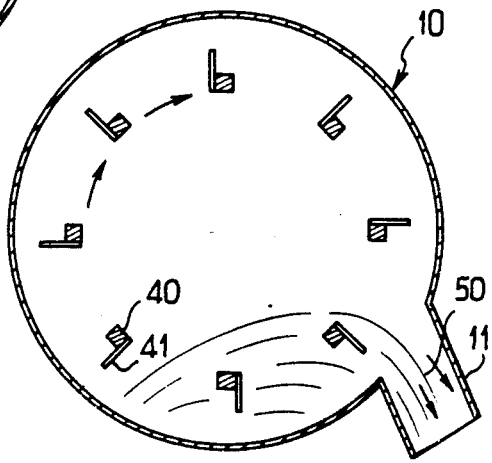

APPLIANCE FOR THE PREPARATION OF BITUMINOUS COATED PRODUCTS WITH A STATIONARY MIXER

FIELD OF THE INVENTION

The invention relates to an apparatus for the preparation of bituminous coated products from virgin aggregates, liquid bitumen and recycled bituminous coatings.

BACKGROUND OF THE INVENTION

Apparatus for the preparation of bituminous coatings for road surfaces from virgin aggregates, liquid bitumen and dry bulk materials, in which recycled spent bituminous coatings are incorporated, are known in the art. These usually consist of a large cylindrical mounted on a platform for rotation about its axis and inclined slightly relative to the horizontal plane. The virgin aggregates and the dry bulk materials are introduced into the drum at one of its ends. The coatings recycled in granular form are introduced via a recycling ring surrounding the drum in an intermediate zone between its two ends.

A burner enters the drum at one of its ends and makes it possible to circulate hot gases which ensure the drying and heating of the materials circulating in the drum.

Such a drum ensures at the same time the drying and heating of the cold and wet aggregates entering the drum, reheating of the recycled coatings and mixing of the virgin aggregates and recycled coatings, in contact with liquid bitumen conveyed into the drum by means of an injection pipe.

The inner wall of the drum is fitted with blades of different shapes according to the zones of the drum, in order, as a result of the rotation of the drum, to ensure transport, agitation and/or clearance of the materials circulating in the drum. In comparison with an older process in which the drying and heating of the aggregates took place in a rotary dryer and the mixing with the liquid bitumen was carried out in an independent mixer having a stationary casing, the integration of the drying, heating and mixing functions in one and the same drum afforded a certain degree of simplification of the procedures and equipment used. However, the disadvantage of drying/mixing drums is that a flame, very hot gases and liquid bitumen coexist in the same containment. Because of this, bitumen vapor is carried along by the hot gases circulating in the drum, thereby producing rapid clogging of the back filters used for removing dust from the gases leaving the drum and discharge of harmful vapors into the atmosphere. These disadvantages are especially pronounced in drying/mixing drums with parallel flows, i.e., those where the hot gases circulate inside the drum in the same direction as the solid materials.

Furthermore, any additives to the coatings, for example in the form of powders or fibers, must either be introduced into the drum at one of its two ends, or it is necessary to use an auxiliary device, such as the recycling ring employed for introducing recycled bituminous coatings into the drum, in an intermediate zone between its two ends.

It is not desirable to introduce these additives at the inlet end of the drum, inasmuch as this inlet is usually a long distance from the mixing zone.

Introduction at the outlet end of the drum requires the use of pipes or other devices for the introduction of materials, which are extended inside the drum as far as the entrance of the mixing zone. This complicates the design and the procedures for using the drum.

The recycling ring employed for introducing spent coatings in granular form into the drum is not a suitable means for introducing the dry bulk materials or fibers at the entrance of the mixing zone.

Conversely, in the case of mixers having a stationary casing, it is very easy to place a device for the introduction of dry bulk materials or fibers at any location on such casing, in order to administer the additives at the desired moment, at the start of or during mixing.

The devices employing a separate dryer and mixer with stationary casing therefore have the advantage of reducing the formation and discharges of bitumen vapor and making it easier to administer additives to the coated products during the mixing stage.

However, for a given production capacity, such installations are more complex, more bulky and usually more costly, than the drying/mixing drums.

Moreover, the total motive power necessary for the dryer and mixer of an installation of the old design is markedly higher than the motive power necessary for a drying/mixing drum of the same capacity.

Besides, the installations having a separate dryer and mixer are difficult to use for producing bituminous coatings from virgin aggregates and bitumen, in which a certain proportion of recycled coatings is incorporated.

US-A-2,421,345 discloses a drying drum in which the hot gases coming from the burner and the aggregates circulate in opposite directions, Furthermore, the end of the drum opposite the inlet end for the aggregates communicates with a mixer having a stationary casing, into which the aggregates pour at the outlet of the drum. The drum is extended by longitudinal supports carrying agitating vanes which move inside the stationary-casing mixer during the rotation of the drum. Liquid bitumen is incorporated in the aggregates in the mixer. In such an apparatus, the burner flame is generated in the mixing zone, thereby giving rise to the formation of bitumen vapors, even if a cylindrical chamber is provided at the center of the casing of the mixer in order to prevent direct contact between the bitumen and the flame.

Moreover, the appliance according to US-A2,421,345 does not make it possible to incorporate spent coatings in the materials circulating in the drum.

SUMMARY OF THE INVENTION

The object of the invention is to provide an apparatus for the preparation of bituminous coated products from virgin aggregates, liquid bitumen and recycled bituminous coatings, comprising a cylindrical drum mounted for rotation about its axis and inclined slightly relative to the horizontal plane, a device for feeding cold and wet aggregates via the upper inlet end of the drum, a burner projects into the drum at its lower outlet end, in such a way that hot gases from the flame of the burner and the virgin aggregates circulate in opposite directions, a mixer which consists of a stationary casing into which the outlet end of the drum opens, and which is equipped with a means for injecting liquid bitumen and with a device for the removal of coatings, and mixing means fastened to the drum and extending the drum axially in the direction of its outlet, so as to enter the casing of the mixer, mixing being ensured by the setting in rotation of the mixing means during the rotation of the drum, this apparatus although simple and relatively compact, making it possible to prepare coated products containing any proportion of recycled materials and additives of any type, without generating an excessive quantity of bitumen vapor.

To achieve this object, the burner has an elongate body opening into a flame zone distant from the ends of the drum, and the drum is provided in a zone distant from its ends and located in the vicinity of that end of the burner body from which the flame is generated, with a recycling ring surrounding the casing of the drum and allowing recycled coatings to be introduced into the drum, and the casing of the mixer delimits, around the body of the burner, a mixing zone separated from the flame zone by the zone of introduction of recycled materials.

BRIEF DESCRIPTION OF THE DRAWINGS

To facilitate easier comprehension, an embodiment of apparatus according to the invention will now be described with reference to the accompanying drawings.

FIG. 6 is a section along line6—6 of FIG. 1.

FIG. 7 is a section along line 7—7 of FIG. 1.

FIG. 8 is a section along line 8—8 of FIG. 1.

FIG. 9 is a section along line 9—9 of FIG. 1.

DESCRIPTION OF PREFERRED EMBODIMENT

Figure 1:
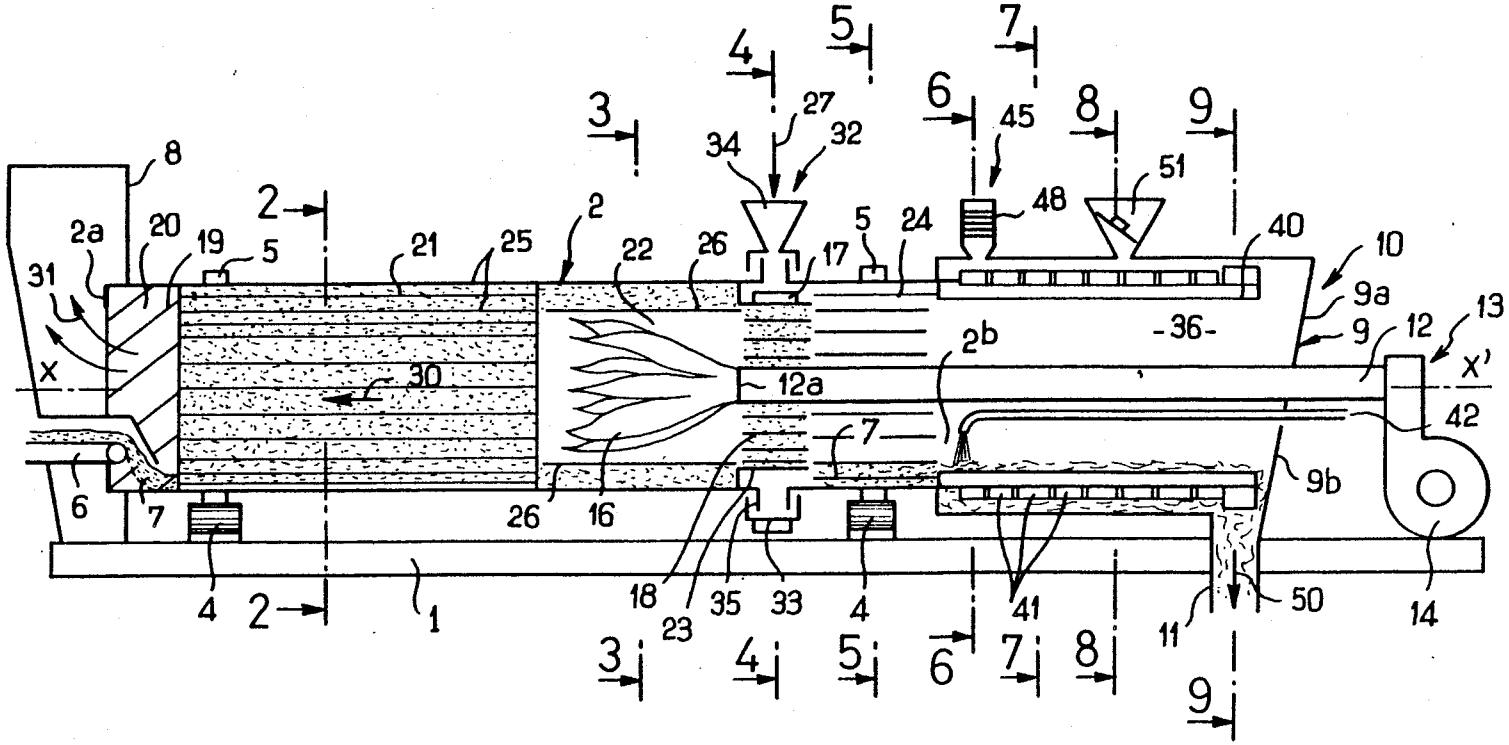
FIG. 1 is a front elevation view of the apparatus according to the invention.

FIG. 1 shows the apparatus comprising a platform 1 for supporting a cylindrical drum 2 which is mounted on the platform for rotation about its axis XX'. The platform 1 includes devices (not shown) for bearing on the ground of the site, and means for adjusting its inclination relative to the horizontal plane, thereby making it possible to adjust the inclination of the axis XX' of the drum 2.

If mobility is desired, the platform 1 can consist of the platform of a road trailer having extendible and retractable props for installing the appliance on the site.

The cylindrical casing of the drum 2 is mounted on the platform 1 for rotation about its axis XX' by means of four track rollers 4 and two roller rings 5.

The drum 2 has a first end 2a, or inlet end, through which enters the outlet end of a band conveyor 6 supplying the drum with cold and wet aggregates 7.

The inlet end 2a of the drum is engaged inside a suction box 8 for the gases circulating in the drum.

The outlet end 2b of the drum opposite its inlet end 2a is engaged inside the stationary casing 9 of the mixer 10.

The casing 9 is attached to the platform 1 and has an outlet chute 11 for the coated bituminous materials produced by the apparatus.

The stationary casing 9, which is cylindrical, is attached to the platform 1 in the axial extension of the drum 2. This casing 9 comprises a rear closure plate 9a through which passes the elongate cylindrical body 12 of a burner 13 having a fan 14 carried by the platform 1.

The body of the burner 12, arranged along the axis XX' common to the drum 2 and to the stationary casing 9 of the mixer, passes through the entire central part of the mixer and at its end 12a opens into the drum 2 at some distance from its outlet end 2b engaged in the casing 9 of the mixer.

The flame 16 of the burner is generated inside the drum from the end 12a of the body 12 of the burner, in a zone distant both from the inlet end 2a and the outlet end 2b of the drum.

The drum 2 has, over its length, several successive zones which differ from one another both as to the shape of the elements provided on the inner surface of the drum in the relevant zone and as to the function performed by this zone when the apparatus is in operation.

From the inlet end 2a of the drum to the outlet end, the drum comprises an introduction zone 20, a drying zone 21, a flame zone 22, a zone for the introduction of recycled coatings 23 and a reheating and blending zone 24. Thus, the zone for introducing the recycled coatings 23 ensures that the reheating and blending zone 24 and the mixing zone 36 located inside the casing 9 are separated and isolated from the flame zone 22.

The zone 20 ensures that the aggregates 7 delivered to the drum by the conveyor 6 are introduced rapidly into the drying zone 21. In this zone, the inner wall of the drum 2 is equipped with fins 19 projecting radially relative to the inner surface of the drum and arranged along helices whose axis is the axis XX' of the drum.

Figure 2:
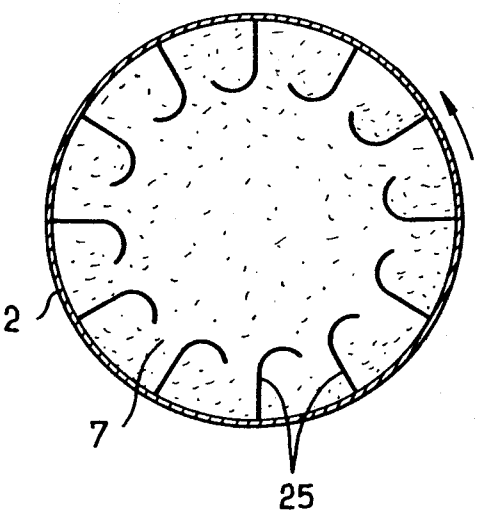
FIG. 2 is a section along line 2—2 of FIG.
Figure 4:
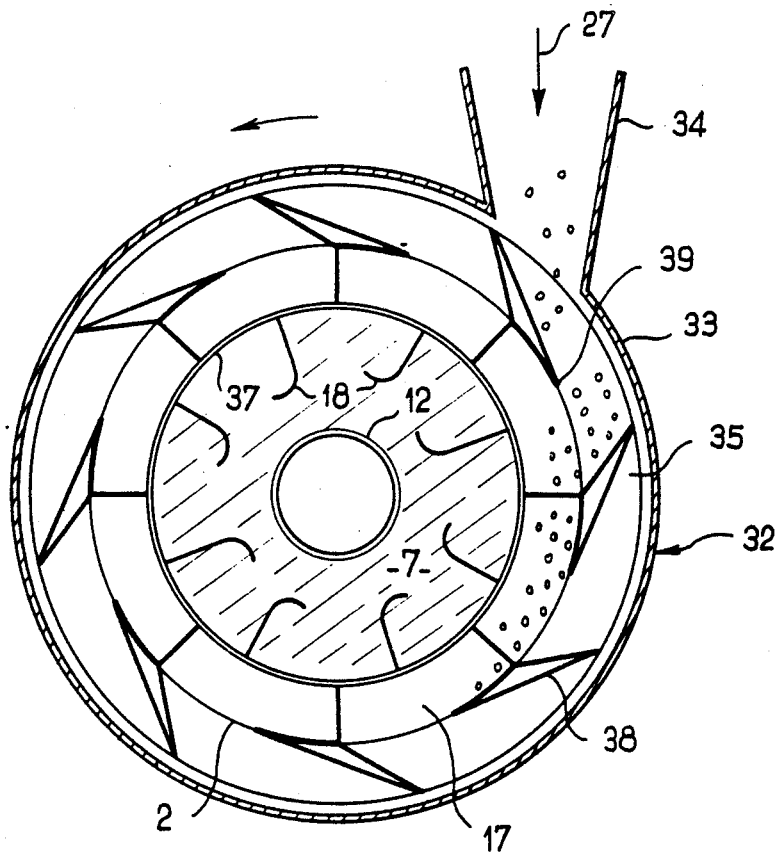
FIG. 4 is a section along line 4-4 of FIG. 1.

As can be seen from FIGS. 1 and 2, in the drying zone 21 the inner surface of the drum is provided with lifting blades 25, whose cross-section, which may, for example, be hook-shaped, makes it possible to lift the aggregates 7 as far as the upper part of the drum and to produce a continuous curtain of aggregates falling in a cascade into the section of the drum during its rotation. The continuous curtain of aggregates has passing through it the hot gases coming from the burner flame 16 located in zone 22 and circulating in the axial direction of the drum (arrow 30). The drum is inclined that its inlet end 2a is at a level higher than its outlet end 2b. The solid materials, particularly the aggregates 7, therefore circulate in the drum in the direction opposite to the direction of circulation 30 of the hot gases. The cold and wet aggregates 7, when they are entering the drum, are dried and heated as a result of a counterflow circulation of hot gases. The gases, when they escape via the suction box 8 (arrows 31), are laden with dust released by the aggregates 7 during drying of the latter.

Figure 3:
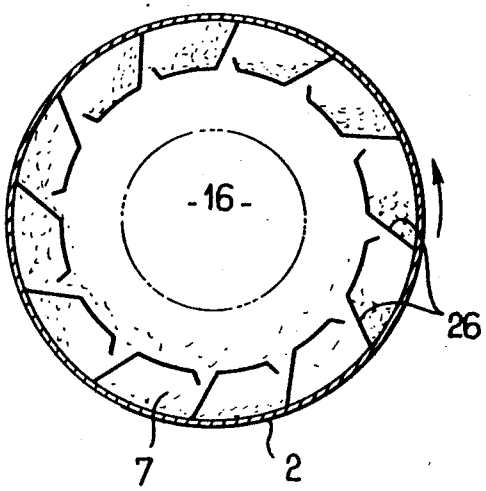
FIG. 3 is a section along line 3—3 of FIG. 1.

In the flame zone 22 (see FIG. 3), the inner wall of the drum 2 is provided with blades 26 making it possible to retain the aggregates 7 dried and heated in the zone 21 against the inner wall of the drum 2. The blades 26, consisting of bent metal strips, have a concave cross-section directed towards the wall of the drum and a virtually plane outer surface directed towards the flame 16.

The blades 26, which have a shape known in the art of drying and coating drums, make it possible to provide a free zone in the central part of the drum, in which the flame 16 can develop.

In zone 23, the drum 2 is surrounded by the recycling ring 32 which comprises an annular stationary part 33, forming in its upper part a hopper 34 for the introduction of the recycled materials 27, and an annular movable part 35 fixed to the outer wall of the drum and having chutes and passage orifices towards the inside of the drum, so as to transfer the recycled materials poured into the hopper 34 inside the zone 23 of the drum.

In a conventional manner, a small inner drum 37 is attached coaxially inside the drum 2 and ensures that the recycled materials introduced into latter drum pass into the zone 23 located downstream of the recycling ring 32.

Helical fins 17 are fastened to the outer surface of the drum 37 and ensure that the recycled coatings 27 are transported towards the zone 24. Hook blades 18 are fastened to the inner surface of the drum 37 and ensure that the aggregates 7 dried and heated in the zone 21 rise and fall again over the entire cross-section of the drum 37. Thus, zone 24 and zone 36 are completely isolated from the flame 16 of the burner by the recycling device and by the curtain of aggregates lifted by the drum 37. The aggregates 7 are subsequently introduced at the entrance of the zone 24 via the inner part of the drum 37 and the recycled coatings via the outer part.

Figure 5:
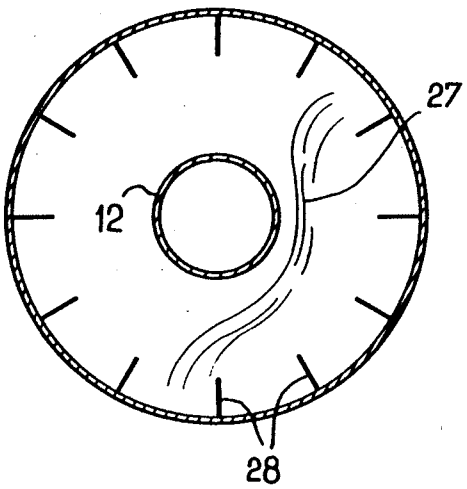
FIG. 5 is a section along line 5—5 of FIG. 1.

In the zone 24 located downstream of the zone 23 for the introduction of recycled coatings (see FIG. 5), the inner surface of the drum 2 is equipped with flat blades 28. As a result of the action of the blades 28, during the rotation of the drum the recycled materials 27 introduced into the drum are blended with the aggregates 7 coming from the drying zone 21 by way of the flame zone 22 and the drum 37.

The blades 28 agitate the bed of granular materials formed by the aggregates 7 and the bituminous coatings 27. The agitation takes place without any appreciable lifting of the bed of materials which remains in contact with the wall of the drum.

The aggregates entering the zone 24 have been dried and heated in the zone 21 and in the zone 22 and are therefore at a high temperature at the moment when they come in contact with the recycled coatings 27. The recycled coated materials are therefore heated as a result of contact with the aggregates, ensuring softening and melting of the bitumen layer covering the recycled coatings. The molten bitumen covers the aggregates at least partially during the blending, with the result that, at the outlet **2*b* of the drum, the products pouring into the stationary chamber 9 of the mixer 10** consist partly of the recycled materials covered with molten bitumen and partly of pre-coated aggregates.

The reheating of the recycled coatings and the blending with the aggregates are carried out in a calm zone which is not subjected to the circulation of the hot gases originating in the zone 22 at the outlet **12*a* of the burner 13**.

The cylindrical casing of the drum carries, at its outlet end **2*b*, a plurality of spars 40 extending the drum 2 in its axial direction within the stationary casing 9 of the mixer 10, as can be seen especially in FIGS. 1 and 7**.

Each of the spars 40 carries a plurality of mixing vanes 41 arranged in succession over the length of the spar.

The spars 40 carrying the mixing vanes 41 form mixing means fixed to the drum 2 and therefore movable in rotation about the axis XX' inside the stationary casing 9 of the mixer 10 during the rotation of the drum 2.

As can be seen from FIG. 7 and from FIGS. 6, 8 and 9, the mixing means consist of eight spars 40 arranged at 45° relative to one another over the periphery of the drum and each carrying a plurality of vanes 41 consisting of steel plates removably fastened to the spars 40 for example by screws. Worn or broken vanes can thus be replaced after a certain period of operation of the mixer.

The mixing assembly can be set in rotation without the use of drive means other than that allowing the drum to be set in rotation about its axis XX'.

The mixer 10 is equipped with a bitumen injection pipe 42 which passes through the rear closing plate **9*a* of the mixer and which opens out at the entrance of the mixer just downstream of the outlet 2*b* of the drum 2**.

The hot pre-coated materials coming out at the end **2*b* of the drum 2 and pouring into the stationary casing 9 of the mixer 10 are therefore sprayed with bitumen and then mixed with this bitumen until they leave via the outlet chute 11 of the mixer 10. The coated products 50 pouring into the chute 11 as a result of gravity can then be collected and, if appropriate, stored and thereafter transported to a roadwork site. The section for the outlet and removal of the coatings from the mixer 10 is shown in FIG. 9**.

The apparatus according to the invention makes it possible, furthermore, to introduce additives into the materials being coated, at any location in the mixer 10, whose casing is stationary.

In the entry zone of the mixer (see FIG. 6) is arranged a device 45 for introducing dry bulk materials 46 into the mixing zone 36. This device 45 consists of a hopper 47, in which a wheel with distributor vanes 48 is mounted rotatably.

Such a device for the introduction of dry bulk materials can be used for introducing filler into the materials at the entrance of the mixing zone 36. Such filler or dry bulk material is necessary in certain proportions, to ensure that the coating is of good quality. It can consist completely or partially of the smalls recovered from the gases leaving via the suction box 8 or of a powdery material of fine granulometry, such as cement.

Whatever its type and granulometry, the filler can be introduced under very good conditions at the entrance of the mixing zone by arranging a distributor, such as that described, on the stationary casing of the mixer in the desired position. The filler will thus be incorporated satisfactorily and without the use of a complex device.

FIG. 8 illustrates a second device for the introduction of additional materials 51, which can preferably, but not necessarily be placed slightly downstream of the filler introduction device 45 on the casing 9 of the mixer 10.

The introduction device 51 makes it possible to introduce into the mixing zone 36 predetermined doses of additives contained in sacks or bags 52. The device 51 comprises a hopper 53 and a trapdoor 54 which is mounted pivotably about an axle 55 and which can be moved between the closing position shown in FIG. 8 and an opening position bearing on the lower wall of the hopper 53 (a movement represented by the double arrow 56).

Doses of additives contained in sacks can thus be introduced manually or automatically at predetermined intervals or singly.

Such additives can consist, for example, of products in the form of powders or fibers capable of changing the mechanical or physical properties or even the color of the coatings, for example, asbestos, iron oxide or plastics.

At all events, the coatings 50 poured out via the chute 11 of the mixer 10 have an absolutely homogeneous composition.

The mixing zone 36 is isolated completely from the flame zone 22 and forms a calm zone in which hot gases do not circulate.

In fact, the gases generated by the flame 16 in the flame zone 22 are directed towards the outlet of the drum **2*a* and the suction box 8**.

The recycled coatings 27 introduced into the reheating and blending zone 23 are not subjected to the heat of and to contact with the hot gases produced by the flame 16 nor to the radiation of this flame, the zone of introduction of the recycled coatings 23 completely separating the flame zone 22 from the zone 24.

As a result, the mixing zone 36 is not subjected to the hot gases coming from the flame zone nor to the radiation of this flame.

If bitumen vapors were generated in the zone 36 or in the zone 24, such vapors would be sucked into the flame zone 22 and forced to pass through the flame, where they would be burnt.

Finally, the gases 31 leaving via the suction box 8 no longer contain any bitumen.

The advantage of the apparatus according to the invention is that it allows highly flexible production of bituminous coatings incorporating any proportion of recycled coatings and containing various additives, without the discharge of bitumen vapor and by the use of a single apparatus mounted on a platform.

Furthermore, the device requires the use of a relatively low motive power for actuating its movable parts.

The mixing assembly fastened to the outlet end of the drum and projecting into the stationary casing of the mixer may be formed in a different way from that described.

It is also quite clear that the stationary casing of the mixer need not be cylindrical, but may, for example, have an octagonal or other polygonal cross-section.

The stationary casing of the mixer may be absolutely coaxial relative to the drum or, on the contrary, offset slightly.

The devices for introducing bitumen and additives may have a different form from those described.

Finally, the appliance according to the invention can be used for the production of any bituminous coated product incorporating a certain quantity of recycled spent coatings.

I claim:

1. Apparatus for the preparation of bituminous coated products from virgin aggregate, liquid bitumen and recycled bituminous coatings, said apparatus comprising a cylindrical drum mounted for rotation about an axis of said drum and inclined slightly relative to a horizontal plane, a device for feeding cold and wet aggregates via an upper inlet end of said drum, a burner projecting into said drum at a lower outlet end of said drum, in such a way that hot gases coming from a flame of said burner and said virgin aggregates circulate in opposite directions, and comprising inside said drum, in sequence from its inlet end to it outlet end;

(a) an introduction zone where an inner surface of said drum is equipped with projecting blades arranged along helices coaxial with said drum;

(b) a drying zone in which said inner surface of said drum is equipped with lifting blades;

a flame zone in which said inner surface of said drum is equipped with blades for retaining materials against said inner surface f said drum and into which opens an end of an elongate body of said burner;

(d) a zone for the introduction of recycled materials located in the vicinity of the end of said body of said burner form which a flame is generated, in which zone said drum is surrounded by a recycling ring and, in an inner part of said drum, is attached to a small drum coaxial with said drum and equipped on an inside of said small drum with lifting blades; and (e) a zone for reheating recycled aggregates and blending said virgin aggregates and said recycled aggregates;

(f) the apparatus further comprising a mixer consisting of a stationary casing into which opens an outlet end of said drum and which is equipped with a means for injecting liquid bitumen and with a device for the removal of coatings, and mixing menas fastened to said drum and extending said drum axially in the directions of its outlet so as to enter said casing of said mixer, mixing being ensured by rotation of said mixing means during rotation of said drum;

(g) said casing of said mixer delimiting around said body of said burner a mixing zone separated from said flame zone by said zone of introduction of recycled materials and by said zone for reheating said recycled aggregate and blending said virgin and recycled aggregates.

2. Apparatus according to claim 1, wherein at least one device for introducing additives into the mixer is fastened to the casing of this mixer.

3. Apparatus according to claim 1, wherein the mixing means consist of a plurality of spars fastened to the periphery of the drum at its outlet end in the axial direction (XX') of this drum, that is to say in the direction of the generatrices of the drum, each of the spars carrying a plurality of mixing vanes arranged in succession over its length.

4. Apparatus according to claim 1, wherein the stationary casing of the mixer is of cylindrical form and is arranged substantially coaxially relative to the drum and surrounds the mixing means.

5. Apparatus according to claim 4, wherein it possesses, fastened to the casing of the mixer, a device for introducing dry bulk materials into the mixer and a device for introducing doses of additives contained in sacks, these devices being arranged in succession over the length of the mixer in the axial direction.

* * * * *